US006059210A

United States Patent [19]

Smith

[11] Patent Number: 6,059,210

[45] Date of Patent: May 9, 2000

[54] ROTOR ASSEMBLY FOR A WASTE PROCESSING MACHINE

[76] Inventor: Leward N. Smith, 11 Box 160, Lake City, Fla. 32024

[21] Appl. No.: 09/234,209

[22] Filed: Jan. 20, 1999

[51] Int. Cl.[7] ..... B02C 13/02; B02C 13/28

[52] U.S. Cl. ..... 241/189.1; 241/191; 241/197; 241/300

[58] Field of Search ..... 241/189.1, 191, 241/197, 300, 101.76

[56] References Cited

U.S. PATENT DOCUMENTS

| | | |
|---|---|---|
| 190,675 | 5/1877 | Gaines . |
| 589,236 | 8/1897 | Williams . |
| 604,283 | 5/1898 | Albrecht . |
| 1,043,831 | 11/1912 | Heinkel et al. . |
| 1,266,894 | 5/1918 | Williams . |
| 1,713,507 | 5/1929 | Ammon . |
| 1,752,290 | 4/1930 | Ammon . |
| 1,844,351 | 2/1932 | Falkenstein . |
| 1,889,129 | 11/1932 | Nielsen . |
| 2,026,790 | 1/1936 | Mankoff . |
| 2,128,194 | 8/1938 | Sheldon . |
| 2,244,577 | 6/1941 | Schreiber . |
| 2,318,219 | 5/1943 | Harris . |
| 2,392,958 | 1/1946 | Tice . |
| 2,663,505 | 12/1953 | Sennholtz . |
| 2,710,635 | 6/1955 | Alexander . |
| 2,863,476 | 12/1958 | Clark . |
| 2,864,420 | 12/1958 | Schmidt . |
| 3,254,687 | 6/1966 | Tertyshnikov . |
| 3,367,585 | 2/1968 | Ratkowski . |
| 3,436,028 | 4/1969 | Koehnen et al. . |
| 3,509,924 | 5/1970 | Newhouse, Jr. . |
| 3,642,214 | 2/1972 | Blackwell. Jr. . |
| 3,844,494 | 10/1974 | Hightower . |
| 3,907,016 | 9/1975 | Nicholson et al. . |
| 4,074,594 | 2/1978 | Dall et al. . |
| 4,077,450 | 3/1978 | Ackerman . |
| 4,117,985 | 10/1978 | Lazareck . |
| 4,129,260 | 12/1978 | Baker . |
| 4,146,184 | 3/1979 | Whitney . |
| 4,162,769 | 7/1979 | Lapointe . |
| 4,168,035 | 9/1979 | Palm et al. . |
| 4,375,233 | 3/1983 | Rossmann et al. . |
| 4,423,646 | 1/1984 | Bernhardt . |
| 4,466,265 | 8/1984 | Wessel . |
| 4,504,019 | 3/1985 | Newell et al. . |
| 4,702,424 | 10/1987 | Widlak . |
| 4,717,083 | 1/1988 | Quast et al. . |
| 4,850,406 | 7/1989 | Krautzberger . |
| 4,872,500 | 10/1989 | Duffey et al. . |
| 4,905,751 | 3/1990 | Dupin . |
| 4,915,310 | 4/1990 | Stelk . |
| 4,917,314 | 4/1990 | Manschwetus . |
| 4,922,977 | 5/1990 | Colton et al. . |
| 4,967,969 | 11/1990 | Griffith, III . |
| 4,982,904 | 1/1991 | Greiner . |

(List continued on next page.)

FOREIGN PATENT DOCUMENTS

| | | |
|---|---|---|
| 59-39461 | 3/1984 | Japan . |
| 61-245956 | 11/1986 | Japan . |
| 62-259659 | 11/1987 | Japan . |

OTHER PUBLICATIONS

Industrial Grinder, manufactured by Haybuster Brochure.
New Maxigrind by Rexworks Brocure (No Date).
The Beast from Bandit Industries, Inc. Brochure.
Bandit Industries, Inc., Construction Journals Brochure (No. Date).
The Beast Recyclers from Bandit Industries . . . with Big Appetites for Waste Brochure.
The Beast Model 15–H, Bandit Industries, Inc. Brochure (No Date).

(List continued on next page.)

*Primary Examiner*—John M. Husar
*Attorney, Agent, or Firm*—Bliss McGlynn, P.C.

[57] ABSTRACT

A rotor assembly for a waste processing machine includes a rotor and a plurality of processing tools mounted to the rotor. The processing tools are a combination of at least two different tools to provide aggressive intake of waste material and aggressive output of reduced waste material.

22 Claims, 4 Drawing Sheets

U.S. PATENT DOCUMENTS

| | | | |
|---|---|---|---|
| 5,027,878 | 7/1991 | Revankar et al. . | |
| 5,042,727 | 8/1991 | Plante . | |
| 5,044,567 | 9/1991 | Hte et al. . | |
| 5,078,328 | 1/1992 | Willingham . | |
| 5,114,085 | 5/1992 | Inui . | |
| 5,150,844 | 9/1992 | McKie | 241/73 |
| 5,169,077 | 12/1992 | Stelk . | |
| 5,205,496 | 4/1993 | O'Donnell et al. . | |
| 5,209,278 | 5/1993 | Carpenter et al. . | |
| 5,238,046 | 8/1993 | Guerard . | |
| 5,285,974 | 2/1994 | Cesarini . | |
| 5,337,801 | 8/1994 | Materkowski . | |
| 5,377,919 | 1/1995 | Rogers et al. . | |
| 5,413,286 | 5/1995 | Bateman . | |
| 5,419,502 | 5/1995 | Morey | 241/101.761 |
| 5,474,239 | 12/1995 | Williams, Jr. et al. . | |
| 5,526,988 | 6/1996 | Rine . | |

OTHER PUBLICATIONS

How to chop yard waste cost!, Farmhand Brochure.

Megagrind by Rexwords 800, Most Productive Portable Materials Processing System Available Brochure (No. Date).

The Beast, Convert Unwanted Wood Into A Saleable Product Quickly And Economically With The Bandit Beast Combination Chippers And Grinders, Sep. 1994.

Bandit's Beast Maintains Nature's Beauty, Construction Equipment Guide, Jun. 1, 1994.

Bandit Industries, Inc., Timber West, Nov. 1993.

Forest Products Equipment Article, Aug. 1994.

The Model 15 Beast, MSW Management, Mar./Apr. 1994.

Want to Lower the Cost of Breaking Down Yard and Other Landfill Waste? Try The Beast From Bandit, Resource Recycling, Nov. 1994.

Turn Your Green Waste Into Green Dollars, Bandit Industries, Inc., Sportsturf, Jun. 1994.

"Product Release" For The New Model 15–H Beast Recycler Offered By Bandit Industries, Waste Handling Equipment New, Jun. 1994.

For Your Chipping and Grinding Needs, Bandit Industries, Inc., Forest Products Equipment, Aug. 1994.

90
92
94
82
84
50a,50b,50c
75
86
58
74
76
78
80
62
56
60
52
64
70
54
66
70
46
49
47
68
49
46
68
40

ROTOR ASSEMBLY FOR A WASTE PROCESSING MACHINE

BACKGROUND OF THE INVENTION

1. Field of the Invention

The present invention relates generally to waste processing machines and, more particularly, to a rotor assembly for a waste processing machine.

2. Description of the Related Art

It is known to provide waste processing machines to reduce waste material. The waste processing machine typically includes a rotor assembly having a rotor and a plurality of processing tools attached to the rotor for reducing the waste material as the rotor rotates. An example of such a waste processing machine is disclosed in pending patent application, U.S. Ser. No. 08/637,233, filed Apr. 24, 1996, entitled "WASTE PROCESSING MACHINE", the disclosure of which is hereby incorporated by reference. In that application, the rotor assembly includes a rotor having a plurality of spaced pairs of mounting arms. The rotor assembly also includes a single processing tool mounted to each pair of mounting arms. The processing tool is the same for each pair of mounting arms.

Typically, the processing tool is of a cutting type for cutting waste material and provides aggressive intake of waste material, but poor output of reduced waste material. Another type of processing tool is of a bullet type for splitting waste material to reduce it without cutting and provides aggressive intake of waste material, but provides poor output of reduced waste material. Yet another type of processing tool is of a fan type for impacting waste material such as grass and leaves to reduce it without cutting and provides poor intake of waste material, but provides aggressive output of reduced waste material.

Although the above waste processing machine has worked well, it suffers from the disadvantage that one type of processing tool for the rotor assembly will aggressively intake waste material but poorly output reduced waste material or poorly intake waste material but aggressively output reduced waste material. Thus, there is a need in the art to provide a rotor assembly for a waste processing machine that allows for aggressive intake of waste material and aggressive output of reduced waste material from the waste processing machine.

SUMMARY OF THE INVENTION

It is, therefore, one object of the present invention to provide a rotor assembly for a waste processing machine.

It is another object of the present invention to provide a rotor assembly for a waste processing machine that has a combination of different processing tools in a manner that provides aggressive intake of waste material and aggressive output of reduced waste material.

To achieve the foregoing objects, the present invention is a rotor assembly for a waste processing machine. The rotor assembly includes a rotor and a plurality of processing tools mounted to the rotor. The processing tools comprise a combination of at least two different processing tools to provide aggressive intake of waste material and aggressive output of reduced waste material in the waste processing machine.

One advantage of the present invention is that a rotor assembly is provided for a waste processing machine. Another advantage of the present invention is that the rotor assembly provides different combinations of processing tools in a manner that provides aggressive intake of the waste material and aggressive output of the reduced waste material by the rotor assembly in the waste processing machine.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
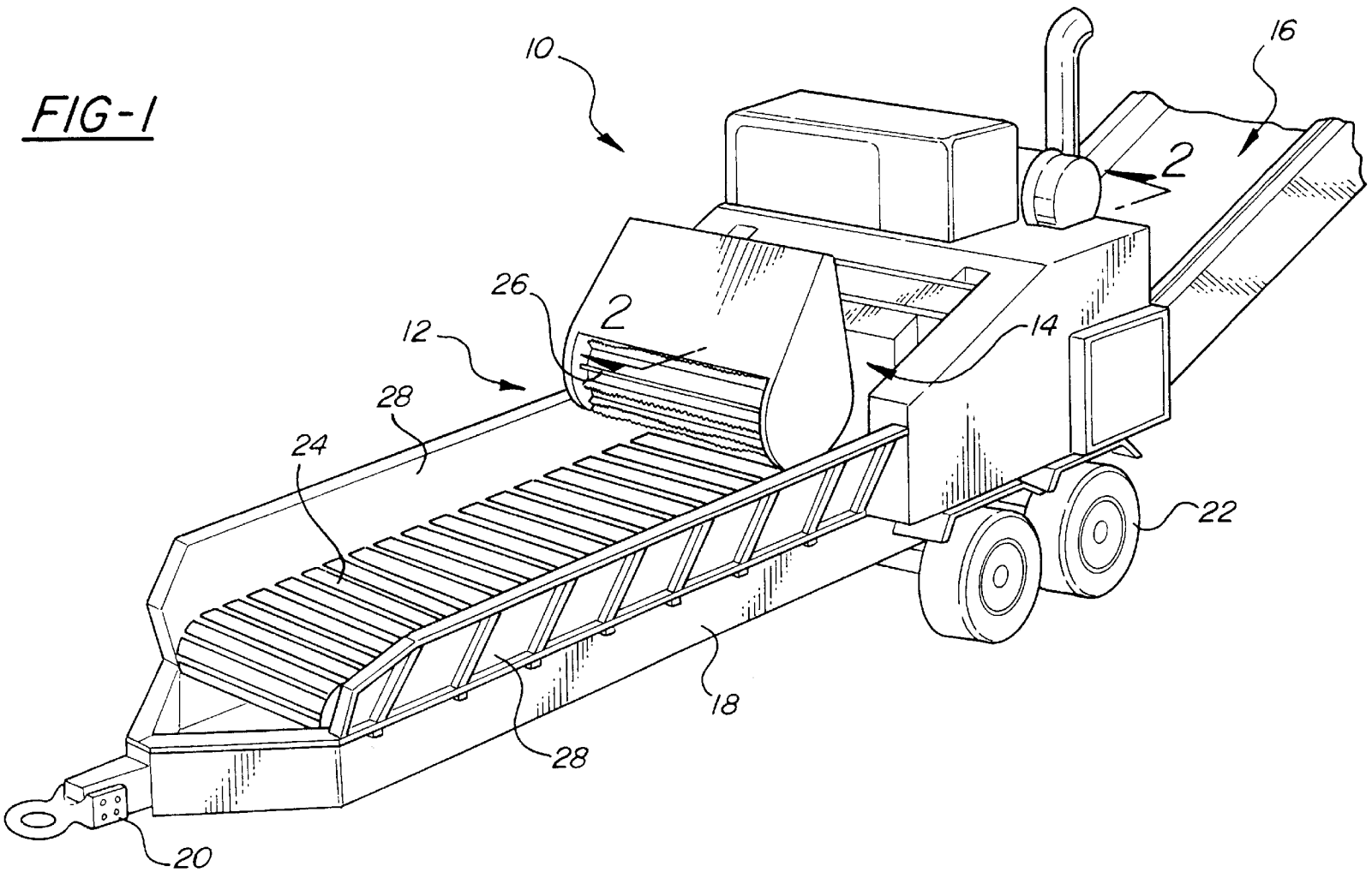
FIG. 1 is a perspective view of a waste processing machine.

Referring now to the drawings and in particular to FIG. 1, one embodiment of a waste processing machine 10 for reducing waste material is shown. The waste processing machine 10 includes an infeed system 12, a waste reducing system 14, and a discharge system 16. Waste material enters the waste processing machine 10 through the infeed system 12 where it is directed to the waste reducing system 14. The waste reducing system 14 reduces the waste material and directs it to the discharge system 16 where the reduced waste material is expelled from the waste processing machine 10. The waste processing machine 10 may be supported on a trailer framework 18 having a tongue mount 20 provided at a front thereof and wheels 22 near a rear of the framework 18. It should be appreciated that, with this structure, the infeed system 12 and waste reducing system 14 can be transported together while the discharge system 16 can be transported separately therefrom.

Figure 2:
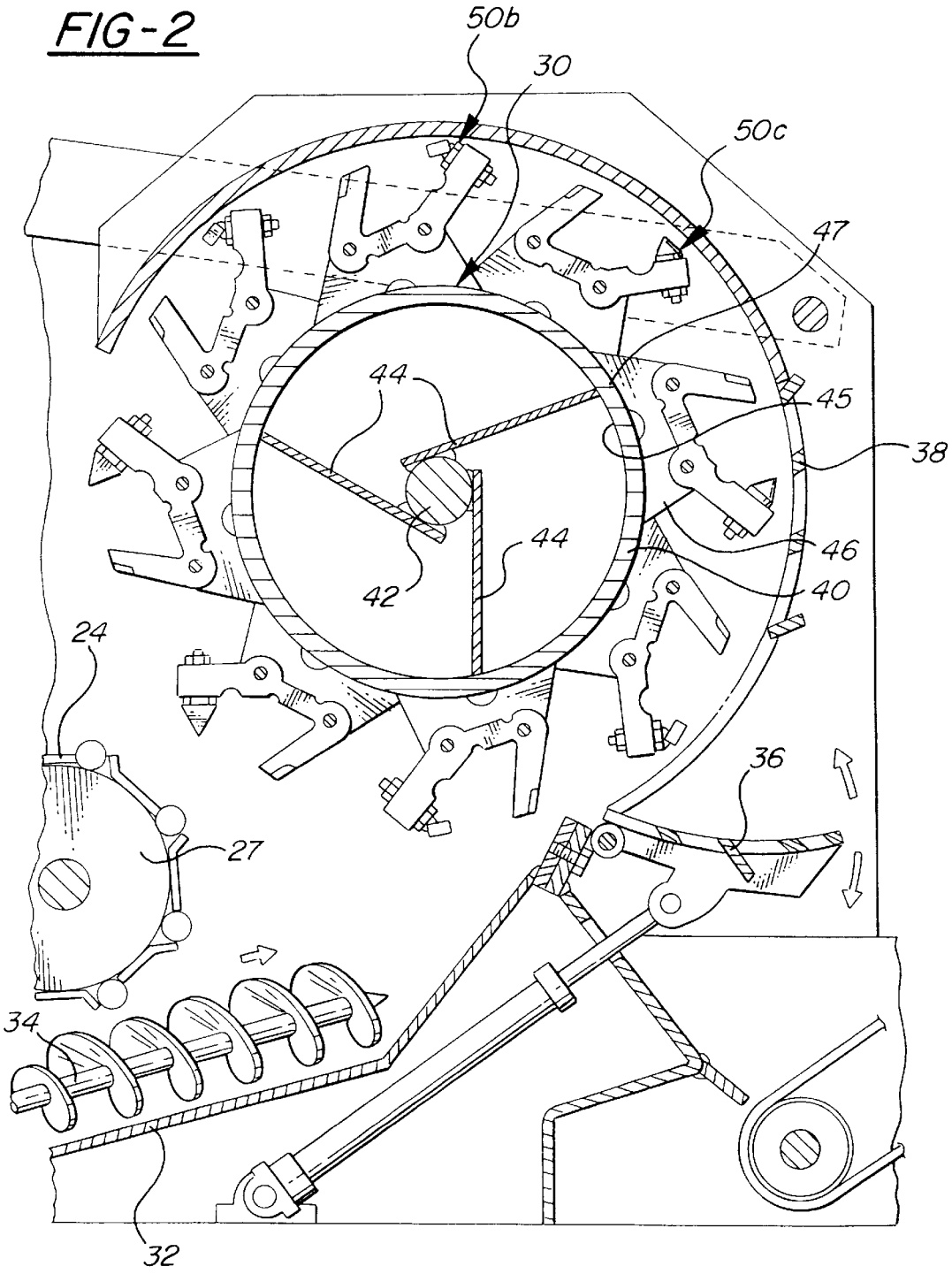
FIG. 2 is a sectional view of a rotor assembly, according to the present invention, and the waste processing machine taken along line 2—2 of FIG. 1.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 30 to be described of the waste reducing system 14. The infeed conveyor 24 is the sole means of support for the waste material and acts as a primary anvil for reducing the waste material by the rotor assembly 30 to be described. Opposed side walls 28 are provided on opposite sides of the conveyor 24 to contain the waste material. It should be appreciated that waste material is placed on the infeed conveyor 24 which moves the waste material into contact with the feed wheel assembly 26 which, in turn, rolls the waste material through an inlet opening into contact with the waste reducing system 14.

Figure 3:
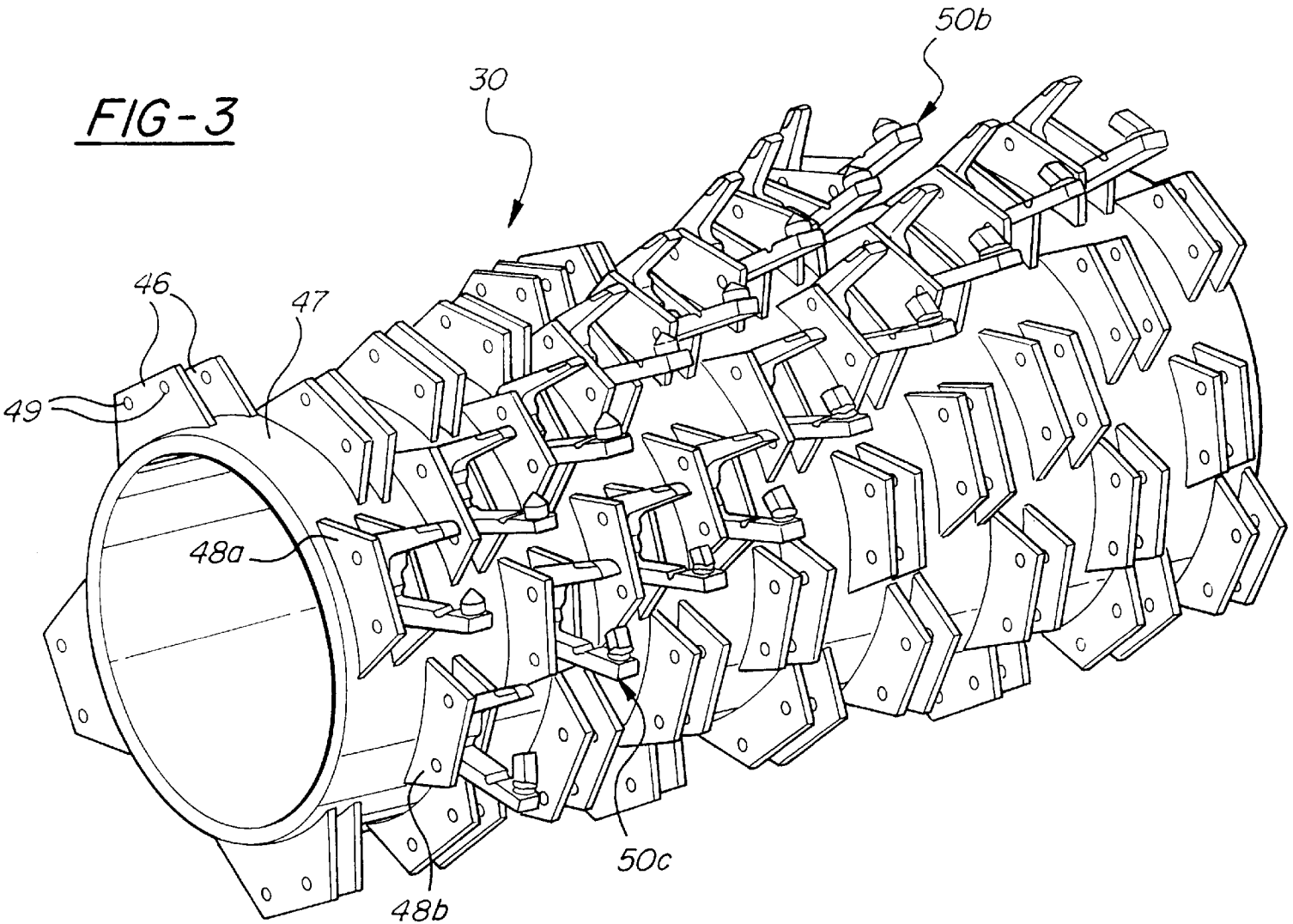
FIG. 3 is a perspective view of the rotor assembly of FIG. 2.

Referring to FIGS. 2 and 3, the waste reducing system 14 includes a rotor assembly, according to the present invention and generally indicated at 30. The waste reducing system 14 also includes a housing 32 disposed about the rotor assembly 30 and a plurality of regrind augers 34 positioned at a bottom of the housing 32. The waste reducing system 14 further includes a movable concave screen 36 and a fixed concave screen 38. It should be appreciated that the waste reducing system 14 reduces waste material by the rotor assembly 30 which passes through the screens 36,38 to the discharge system 16. It should also be appreciated that the regrind augers 34 move reduced waste product into contact with the rotor assembly 30 for further reduction to pass through the screens 36,38.

The rotor assembly 30, according to the present invention, includes a rotor 40. The rotor 40 is a generally cylindrical tube having a longitudinal axis. The rotor 40 is mounted to a coaxially disposed shaft 42 by multiple braces 44 extending tangentially from an outer surface of the shaft 42 to an inner surface 45 of the rotor 40. Preferably, each brace 44 is an elongated plate-like member fixed tangentially to the shaft 42 by suitable means such as welding and is similarly secured to the inner surface of the rotor 40 by suitable means such as welding. It should be appreciated that a power source (not shown) is connected to the shaft 42 in a well-known manner and is adapted to turn the shaft 42 and rotor 40.

Figure 4:
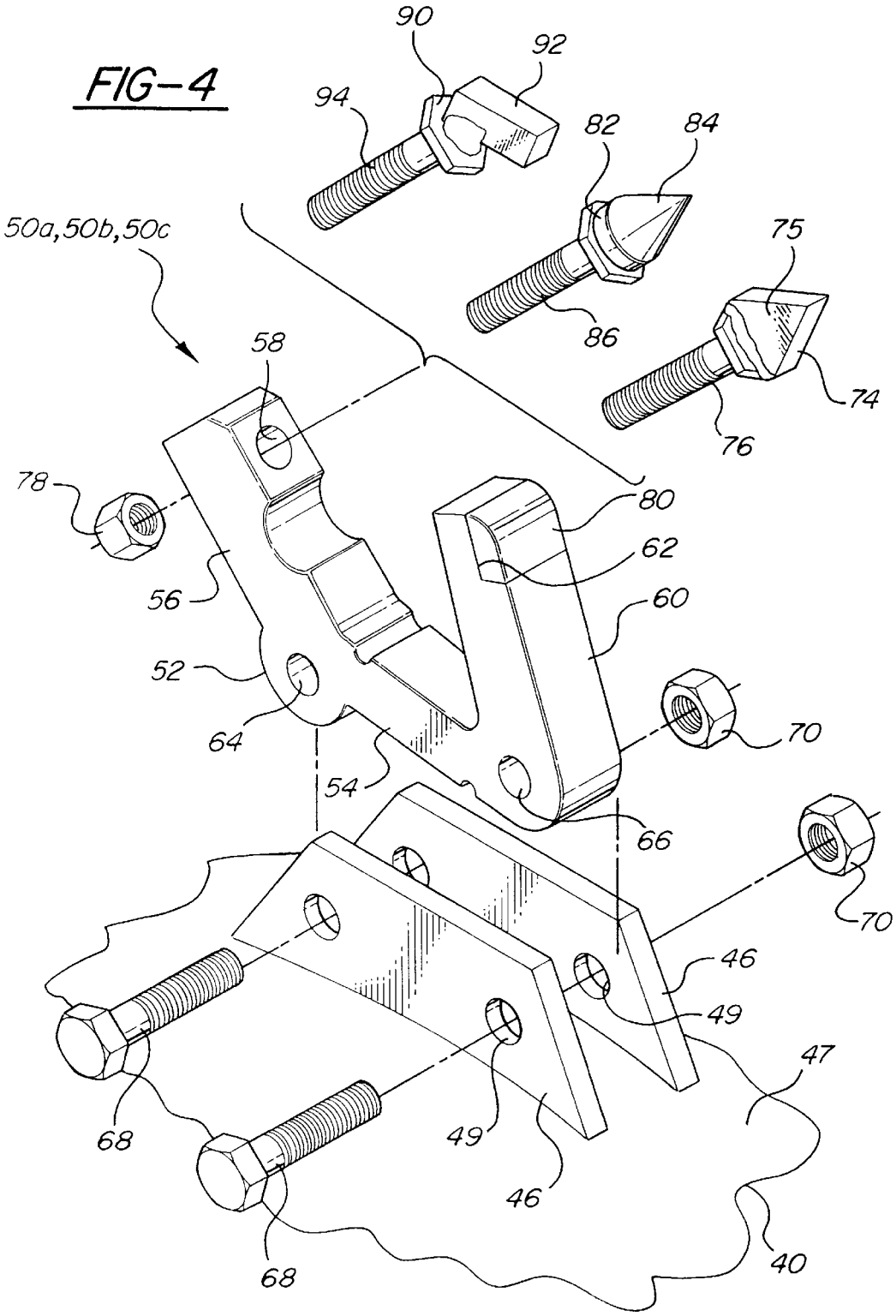
FIG. 4 is an exploded perspective view of a portion of the rotor assembly of FIG. 2.

Referring to FIGS. 2 through 4, the rotor assembly 30 also includes a plurality of spaced pairs of mounting arms 46 mounted to an outer surface 47 of the rotor 40 by suitable means such as welding. Each mounting arm 46 is generally trapezoidal in shape and includes at least one, preferably a pair of spaced apertures 49 extending therethrough. The mounting arms 46 are wrapped about the rotor 40 in a first spiral 48*a* and a second spiral 48*b* spaced or offset from the first spiral 48*a*. The rotor assembly 30 further includes a combination of processing tools, according to the present invention and generally indicated at 50*a*, 50*b*, 50*c*, mounted to the mounting arms 46. The first spiral 48*a* and second spiral 48*b* of mounting arms 46 extend about the rotor 40 so that in one rotation of the rotor assembly 30, every point on an imaginary axial line segment positioned adjacent to the rotor assembly 30 will be contacted by the processing tools 50*a*, 50*b*, 50*c* mounted to the rotor assembly 30. Preferably, one of the processing tools 50*a*,50*b*,50*c* is mounted to the mounting arms 46 of the first spiral 48*a* and another one of the processing tools 50*a*,50*b*,50*c* is mounted to the mounting arms 46 of the second spiral 48*b*.

Each of the processing tools 50*a*, 50*b*, 50*c*, according to the present invention, includes a tool holder 52 having a general "C" shape. The tool holder 52 has a body 54 extending circumferentially and a first or trailing arm 56 extending radially at an angle therefrom with a first aperture 58 extending therethrough. The tool holder 52 also includes a second or leading arm 60 extending radially at an angle from the body 54 with a recess 62 at one end thereof. The tool holder 52 includes an aperture 64 and 66 at a lower radial end of the first arm 56 and second arm 60, respectively, and extending axially therethrough. The body 61 has a width or thickness less than the first arm 62 and second arm 66. The tool holder 52 is continuous, integral, unitary and made as one-piece. It should be appreciated that the apertures 64,66 of the tool holder 52 are aligned with the apertures 49 of the mounting arms 46.

The rotor assembly 30 includes at least one, preferably a pair of fasteners such as bolts 68 and nuts 70 for retaining the processing tool 50*a*, 50*b*, 50*c* to the mounting arms 46. The bolts 68 extend through the apertures 49 in the mounting arms 46 and the apertures 64,66 of the tool holder 52 and threadably engage the nuts 70. It should be appreciated that the tool holder 52 is disposed between the mounting arms 46.

The processing tool 50*a* also includes a cutting tool 74 attached to the tool holder 52. The cutting tool 74 has a carbide member 75 attached to a shaft 76 by suitable means such as brazing. The carbide member 75 is generally triangular in shape and is used to cut the waste material. The shaft 76 extends axially through the aperture 58 in the first arm 56 and is removably secured to the first arm 56 by suitable means such as a nut 78 threadably engaging the shaft 76. The processing tool 50*a* also has a wear bar 80 disposed in the recess 62 of the second arm 60. The wear bar 80 is a carbide member secured to the second arm 60 by suitable means such as brazing. It should be appreciated that the second arm 60 operates as a depth-limiting guide and the first arm 56 operates as a cutter to cut and reduce the waste material. It should also be appreciated that the cutting tool 74 provides aggressive intake of the waste material for the rotor assembly 30 and provides poor output of the reduced waste material from the rotor assembly 30.

The processing tool 50*b* includes a bullet tool 82 attached to the tool holder 52. The bullet tool 82 has a head 84 with a generally bullet or frusto-conical shape to split waste material as it enters the rotor assembly 30. The bullet tool 82 has a shaft 86 attached to the head 84 by suitable means such as welding. The shaft 86 extends axially through the aperture 58 in the first arm 56 and is removably secured to the first arm 56 by suitable means such as the nut 78. The remainder of the processing tool 50*b* is similar to the processing tool 50*a*. It should be appreciated that the head 84 and shaft 86 may be integral and formed as one piece. It should also be appreciated that the bullet tool 82 provides aggressive intake of the waste material into the rotor assembly 30 and poor output of the reduced waste material from the rotor assembly 30.

The processing tool 50*c* includes a fan tool 90 attached to the tool holder 52. The fan tool 90 has a head 92 with a trapazodial or fan shape to push the reduced waste material to exit the rotor assembly 30. The fan tool 90 has a shaft 94 attached to the head 92 by suitable means such as welding. The shaft 94 extends axially through the aperture 58 in the first arm 56 and is removably secured to the first arm 56 by suitable means such as the nut 78. The remainder of the processing tool 50*c* is similar to the processing tool 50*a*. It should be appreciated that the head 92 and shaft 94 may be integral and formed as one piece. It should also be appreciated that the fan tool 82 provides poor intake of the waste material into the rotor assembly 30 and aggressive output of the reduced waste material from the rotor assembly 30.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A rotor assembly for a waste processing machine comprising:

a rotor rotatable about an axis;

a plurality of processing tools mounted to and wrapped about said rotor in a first spiral and a second spiral to reduce waste material, said first spiral and said second spiral extend about said rotor so that in one rotation of said rotor every point on an imaginary axial line segment positioned adjacent said rotor will be contacted by said processing tools mounted to said rotor; and said processing tools comprising a combination of at least two different tools to provide aggressive intake of waste material and aggressive output of reduced waste material with one of the at least two different tools mounted to the first spiral and the other of the at least two different tools mounted to the second spiral.

2. A rotor assembly as set forth in claim 1 wherein said tools are from a group comprising a cutting tool, bullet tool and fan tool.

3. A rotor assembly as set forth in claim 2 wherein said bullet tool has a generally conical shape.

4. A rotor assembly as set forth in claim 2 wherein said fan tool has a generally trapezoidal shape.

5. A rotor assembly as set forth in claim 2 wherein said cutting tool has a carbide member for cutting waste material.

6. A rotor assembly as set forth in claim 1 wherein each of said processing tools comprise a tool holder and one of said tools.

7. A rotor assembly as set forth in claim 6 wherein said tool holder comprises a first arm extending radially and a second arm extending radially and spaced from said first arm.

8. A rotor assembly as set forth in claim 7 wherein said tool is attached to said first arm.

9. A rotor assembly as set forth in claim 7 including a wear bar attached to said second arm.

10. A rotor assembly as set forth in claim 1 including a plurality of pairs of axially spaced mounting arms operatively connected to said rotor.

11. A rotor assembly as set forth in claim 10 including least one fastener to attach said tool holder to one of said pairs of mounting arms.

12. A rotor assembly as set in claim 11 wherein said tool holder has a plurality of apertures extending axially therethrough, said at least one fastener extending axially through each of said apertures.

13. A rotor assembly for a waste processing machine comprising:

a rotor rotatable about a horizontal axis;

a plurality of processing tools disposed circumferentially and wrapped about said rotor in a first spiral and a second spiral to reduce waste material, said first spiral and said second spiral extend about said rotor so that in one rotation of said rotor every point on an imaginary axial line segment positioned adjacent said rotor will be contacted by said processing tools mounted to said rotor;

wherein said processing tools comprise a combination of at least two different tools from a group comprising a cutting tool, a bullet tool and a fan tool with one of the at least two different tools mounted to the first spiral and the other of the at least two different tools mounted to the second spiral.

14. A rotor assembly as set forth in claim 13 wherein each of said processing tools comprise a tool holder and one of said tools.

15. A rotor assembly as set forth in claim 14 including a plurality of pairs of axially spaced mounting arms operatively connected to said rotor.

16. A rotor assembly as set forth in claim 15 including least one fastener to attach said tool holder to one of said pairs of mounting arms.

17. A rotor assembly as set in claim 16 wherein said tool holder has a plurality of apertures extending axially therethrough, said at least one fastener extending axially through each of said apertures.

18. A rotor assembly as set forth in claim 17 wherein said tool holder comprises a first arm extending radially and a second arm extending radially and spaced from said first arm, wherein said tool is attached to said first arm.

19. A rotor assembly as set forth in claim 18 including a wear bar attached to said second arm.

20. A rotor assembly as set forth in claim 13 wherein said bullet tool has a generally conical shape.

21. A rotor assembly as set forth in claim 13 wherein said fan tool has a generally trapezoidal shape.

22. A rotor assembly as set forth in claim 13 wherein said cutting tool has a carbide member for cutting waste material.

* * * * *